US007028788B2

(12) United States Patent
Strand et al.

(10) Patent No.: US 7,028,788 B2
(45) Date of Patent: Apr. 18, 2006

(54) WEAR SLEEVE

(75) Inventors: Stein Strand, Bergen (NO); Per Gunnar Nilsen, Sandnes (NO); Atle Stlan Vaalana, Harfsfjord (NO)

(73) Assignee: Tubular Protection Systems AS, Bergen (NO)

( * ) Notice: Subject to any disclaimer, the term of this patent is extended or adjusted under 35 U.S.C. 154(b) by 107 days.

(21) Appl. No.: 10/479,442

(22) PCT Filed: May 29, 2002

(86) PCT No.: PCT/NO02/00187

§ 371 (c)(1),
(2), (4) Date: Dec. 1, 2003

(87) PCT Pub. No.: WO02/097233

PCT Pub. Date: Dec. 5, 2002

(65) Prior Publication Data

US 2004/0173382 A1 Sep. 9, 2004

(30) Foreign Application Priority Data

Jun. 1, 2001 (NO) ..... 20012742

(51) Int. Cl.
*E21B 17/00* (2006.01)

(52) U.S. Cl. ..... 175/325.2; 166/242.6

(58) Field of Classification Search ..... 175/325.1, 175/325.2; 166/242.6
See application file for complete search history.

(56) References Cited

U.S. PATENT DOCUMENTS 2,301,495 A * 11/1942 Abegg ..... 175/325.1
2,336,974 A * 12/1943 Abegg ..... 175/325.2
2,440,441 A * 4/1948 Hanes ..... 175/325.2
3,754,609 A * 8/1973 Garrett ..... 175/323
3,923,324 A * 12/1975 Cruickshank et al. ..... 285/16
5,090,500 A * 2/1992 Yousef et al. ..... 175/320

* cited by examiner

*Primary Examiner*—William Neuder
(74) *Attorney, Agent, or Firm*—Francis C. Hand; Carella Byrne Bain et al

(57) ABSTRACT

Wear sleeve for a drill pipe coupling (10), where a sleeve (18) is arranged in a drill pipe coupling on one of the two adjoining, coupled together drill pipes (12, 14) in a drill string, where the sleeve has an outer diameter that is larger than the outer diameter of the drill pipe coupling (10) and which comprises an inner continuous bore. The inner bore comprises a threaded section (22*a*) arranged for joining together with a corresponding outer threaded section (22) at the one end of the drill pipe coupling (10), whereupon the sleeve (18) is arranged to be securely fastened in the drill pipe coupling to form a wear sleeve.

6 Claims, 1 Drawing Sheet

WEAR SLEEVE

The present invention relates to a wear sleeve for a drill pipe coupling ("tool joint") where, on one or two adjoining drill pipe couplings in a drill string, a sleeve is arranged, where the sleeve has an outer diameter which is larger that the internal diameter of the drill pipe coupling and which comprises an inner continuous bore.

Bore strings made up of drill pipes are used in drilling of oil/gas wells. Mounted onto the drill pipes is a so-called "tool joint", which is a strong coupling normally made of steel, that binds together lengths of drill pipes. Because the wells that are drilled today are very deep and also that both vertical and horizontal drilling takes place, the drill pipes and especially the drill pipe couplings are subjected to much wear. It is known to place different components around the drill pipe, or between the drill pipes to reduce the wear.

From the known methods, NO 179530 shall be mentioned. This particular document concerns a drill string component that encompasses a cylindrical housing which is placed between two drill pipes and where the housing is comprised of two pipe parts that are screwed together with between-lying axial bearings, and which can turn in relation to each other. This is a separate tool which is mounted between the drill pipes as a connecting piece, and, furthermore, increases the number of joints in the drill string and thereby also the danger of leakages, which consequently is very undesirable and should also be avoided. By using this component, the drill string will have more couplings and thus be stiffer, something which is not desirable either, and, furthermore, the weight of the drill string will increase also. As a component, it is not used on the drill pipe itself, in contrast to the present invention which is mounted directly onto a well pipe.

In U.S. Pat. No. 4,380,347, a well tool is described where an elastic/yielding element is placed between two drill pipes and is held in position by the two drill pieces being screwed in, whereupon the element is pushed together. The element is also arranged to be able to rotate in relation to the drill string, in contrast to the present invention. To be able to use this element, the drill pipe must be specially made because the drill pipe coupling must be of a greater pipe thickness. Furthermore, it will be a non-pliers area, neither for "iron roughnecks" nor manual pliers, so that the solution which is described in U.S. Pat. No. 4,380,347 cannot be screwed onto the drill pipe.

The present invention provides a solution which replaces welded on "hard bending", and which is a reinforcement of the drill pipe coupling. The "hard bend" can be replaced manually on the platform instead of the drill pipe having to be sent ashore for burning off and new welding. In addition, the wear sleeve, according to the present invention, will result in the internal layer in the drill pipe not being damaged during mounting, as there will be no heating of the drill pipe.

Among other significant advantages with the present invention shall be mentioned that it will be possible to use the drill pipes much more continuously, because of the replacing of sleeve "hard bending" taking place manually on the drill deck of the platform. The invention can be used on both new and used drill pipes. Furthermore, the costs are reduced considerably.

It is an object of the present invention to provide a wear sleeve which is fitted to a drill pipe coupling where the disadvantages with the known solutions are avoided, and furthermore provides a very simple and solid solution that works and can withstand the considerable stresses that drill pipes are subjected to during drilling, and which also represent a cost saving.

A preferred embodiment of the present invention is characterised in that an inner boring comprises a threaded section adapted for coupling with a corresponding outer threaded section on the one part of the drill pipe coupling, whereupon the sleeve is arranged to be securely fastened to the drill pipe coupling to form a wear sleeve.

Alternative embodiments of the present invention are characterised in that the outer threaded section can be arranged in a machined-down area on an upper drill pipe, and that the machine-down area and the inner boring of the wear sleeve is adapted with an optimal fit. The first end of the sleeve, adjacent to the threaded section, can be trimmed for joining with a corresponding trimmed section at the outer threaded section on the drill pipe coupling. Furthermore, the other end of the sleeve, opposite to the threaded section, can be comprised of an angled flat section arranged to be placed against a corresponding section on the drill pipe coupling. The threaded section of the sleeve can extend only in parts of the axial length direction of the boring. The sleeve can preferably be made of a low alloy steel onto which is laid a layer that is suitable for reducing wear, such as tungsten carbide. The length of the machined down area in the axial direction is corresponding to, or somewhat shorter than, the length of the sleeve, and the threaded section on the machined down area can be comprised of left-hand coarse threads.

The invention shall now be described further with reference to the enclosed drawings that show a preferred embodiment of the present invention, in which.

Figure 1:
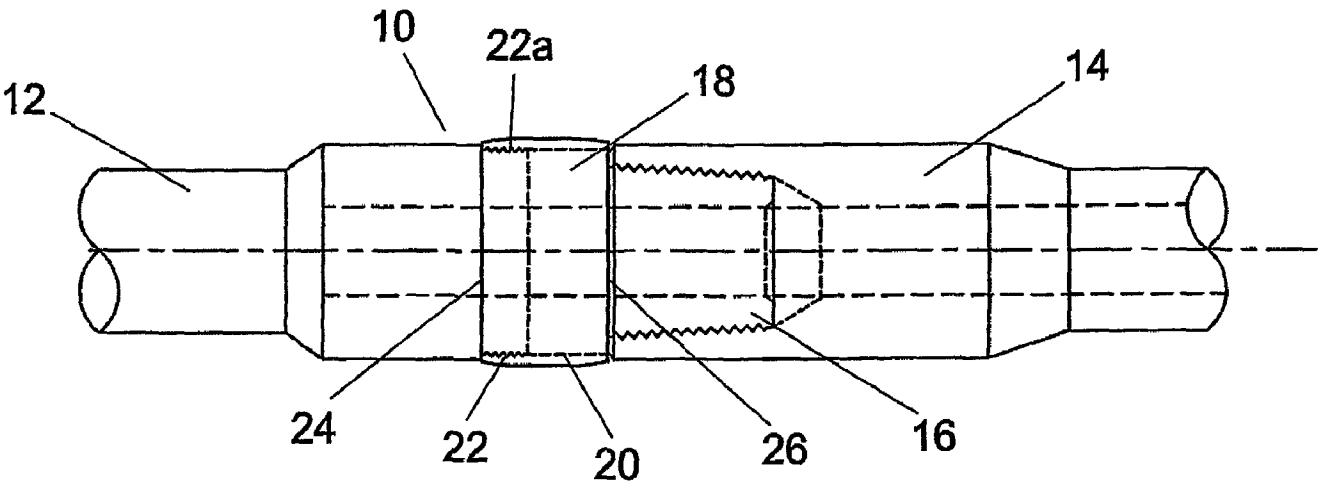
FIG. 1 shows a section of drill pipe coupling with the present invention fitted.
Figure 2:
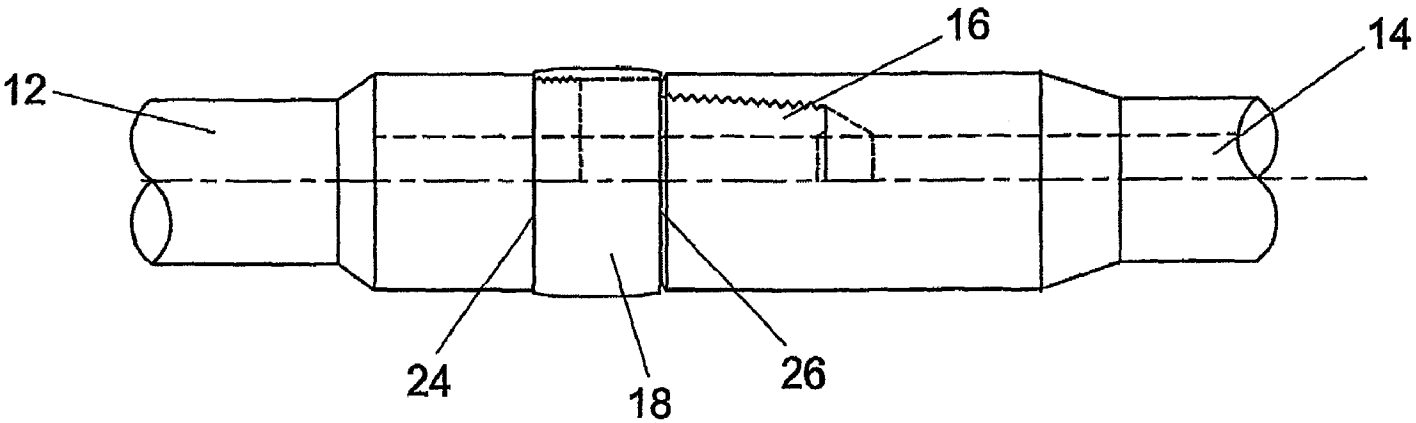
FIG. 2 shows a partial section of a drill pipe coupling corresponding to FIG. 1.

The figures show a drill pipe coupling 10 which is comprised of two drill pipes, an upper drill pipe 12 and a lower drill pipe 14, respectively. The drill pipes are screwed together in a normal way in that the upper drill pipe 12, comprising a conical threaded section 16, is screwed into a corresponding threaded section in the lower drill pipe 14. Assembling of drill pipes is known to people skilled in the art and will not be described further.

The wear sleeve according to the present invention comprises a sleeve 18 that is arranged between the drill pipes 12, 14. To make the sleeve fit the drill pipe coupling, an outer area 20 on the one drill pipe must be machined down. It is preferred that this is done on the upper drill pipe 12, but it can also be carried out on the lower drill pipe 14. The area that shall be machined away can for example, encompass about a 100 mm long section that extends in the opposite direction from around the start of the conical threaded section 16. The length of the area that is machined down is dependent on the length of the sleeve. How much which is machined down is dependent on the type of drill pipe, and must not be so much that it comes into conflict with the 45° phase of the drill pipe coupling. Furthermore, threads 22, preferably left hand threads, are machined on the inner section of the machined down section 20. The inner boring comprises a threaded section 22*a* arranged for threaded union with the threaded section 22 on the upper drill pipe 12. The one end 24 of the sleeve is trimmed for contact with a trimmed edge that arises because of the machining down of the area 20. The other end 26 of the sleeve, opposite to the threaded section 22, can comprise an angled flat section arranged to be placed against a corresponding section on the lower drill pipe 14.

As illustrated, the sleeve 18 has an outer diameter greater than the outer diameter of the upper drill pipe 12 and the outer diameter of the lower dull pipe 14 to define a continuous uninterrupted peripheral wear surface projecting radially beyond the two pipes 12, 14.

In the fitting of the sleeve 18, this is screwed securely onto the upper drill pipe 12, whereupon the conical section 16 (piercing plug) of the drill pipe 12 is fed into the corresponding section of the lower drill pipe 14 and joined together with normal thread systems, so that when the drill pipes 12, 14 are joined together, the sleeve 18 is secured between them and lies in the machined down area 20. It is not an aim of the sleeve to provide a tight connection in the drill string, the conventional drill string will see to that, but by means of the adapted ends 24, 26 of the sleeve, an additional seal can arise. In addition, seals or the like can also be used at the ends 24, 26 of the sleeve to provide an even better seal against leaks from the drill string.

The sleeve can preferably be made from material quality AISI 4145, or the like, and can in addition include a surface covering wear material, such as tungsten carbide or the like. Normally the length of the sleeve will be somewhat shorter than the machined area on the drill pipe and with an outer diameter that is somewhat larger than the outer diameter of the drill pipe coupling. The inner diameter of the sleeve, i.e. the boring, can preferably have a narrow tolerance in relation to the outer diameter of the machined area 20, for example 1/100.

When the sleeve is fitted, it will be part of the drill pipe coupling, and be the part that touches the lining pipes/conducting pipes and the hollow space during drilling and will be the part which suffers most wear and furthermore which is simple to replace.

The invention claimed is:

1. In combination, a first drill pipe having of predetermined outer diameter having a section at one end thereof of a reduced diameter from said predetermined diameter, a thread on said section and a plug of conical shape extending from said section;

a second drill pipe of predetermined outer diameter having an internally threaded conical bore threadably receiving said plug of said first drill pipe; and a wear sleeve having an outer diameter greater than said predetermined outer diameter of said first drill pipe and said predetermined outer diameter of said second drill pipe and defining a single continuous uninterrupted peripheral wear surface extending circumferentially about said sleeve and projecting radially beyond said first pipe and said second pipe, said wear sleeve extending over said section of reduced diameter of said first pipe and abutting said second drill pipe, said wear sleeve having an internally threaded section extending axially thereof and threaded onto said thread of said first pipe.

2. The combination as set forth in claim 1 wherein said section of reduced diameter of said first pipe is a machined down area.

3. The combination as set forth in claim 1 wherein said sleeve has one end abutting with said first pipe.

4. The combination as set forth in claim 1 wherein said internally threaded section of said sleeve extends only over a portion of said sleeve.

5. The combination as set forth in claim 4 wherein said internally threaded section of said sleeve is comprised of left hand threads.

6. The combination as set forth in claim 1 wherein said sleeve is made of a low alloy steel and has a tungsten carbide peripheral surface.

* * * * *